US005971079A

United States Patent [19]

Mullins

[11] Patent Number: 5,971,079

[45] Date of Patent: Oct. 26, 1999

[54] CASING FILLING AND CIRCULATING APPARATUS

[76] Inventor: Albert Augustus Mullins, 18706 Arcaro Glen Ct., Humble, Tex. 77346

[21] Appl. No.: 08/924,579

[22] Filed: Sep. 5, 1997

[51] Int. Cl.[6] ..... E21B 33/12

[52] U.S. Cl. ..... 166/387; 166/76.1; 166/86.2; 166/87.1; 166/187; 166/324

[58] Field of Search ..... 166/76.1, 86.2, 166/87.1, 187, 324, 387

[56] References Cited

U.S. PATENT DOCUMENTS

| | | |
|---|---|---|
| 1,662,311 | 3/1928 | Hamer . |
| 1,866,726 | 7/1932 | Santiago . |
| 2,223,388 | 12/1940 | Scaramucci . |
| 2,620,037 | 12/1952 | McClendon . |
| 3,361,453 | 1/1968 | Brown et al. . |
| 3,863,716 | 2/1975 | Streich . |
| 3,915,226 | 10/1975 | Savage . |
| 4,076,083 | 2/1978 | Sizer . |
| 4,100,968 | 7/1978 | Delano . |
| 4,246,967 | 1/1981 | Harris . |

(List continued on next page.)

OTHER PUBLICATIONS

B.J. Hughes Brochure, "Subsea Cementing Systems", p. 600.

B&W Incorporated Brochure, "B&W Rotating Surface Casing Cementing Method", p. 502.

B&W Incorporated Brochure, "Gravel Compaction", pp. 509–510.

TAM International Brochure, "TAM Casing Circulating Packer", 1991.

Frank's Casing Crew & Rental Tools, Inc., Brochure, "HiTop Model FC–1 Fill–Up/Circulation Tool", undated.

Frank's Casing Crew & Rental Tools, Inc., Technical Manual, "HiTop Oil Tools", Rev. A, Mar. 2, 1995.

Frank's Casing Crew & Rental Tools, Inc., Technical Manual, "HiTop Oil Tools", Rev. A, Feb. 28, 1995.

TAM International Article, Running Procedure for 11"& 7"O.D. Casing Circulating Packer Fill–Up, 13 3/8"& 9 5/8"Casing, Mar. 9, 1993, pp. 1–2.

LaFleur Petroleum Services, Inc., Procedural Brochure, "Autoseal Circulating Head", Apr. 25, 1995, pp. 1–10.

Wassenborg, M., "Franks FC–1 Circulation Packer Washes 13 5/8"Casing to Bottom", The Brief, Jun. 1995.

Halliburton Services, Technical Drawing #3481, undated.

Davis–Lynch, Equipment Catalog No. 11, 1993, 886–895.

Halliburton Information, Oil & Gas Journal, p. 12, undated.

Composite Catalog, 1965, "Brown Hyflo Liner Packers", p. 944, 1965.

(List continued on next page.)

*Primary Examiner*—Roger Schoeppel

*Attorney, Agent, or Firm*—Rosenblatt & Redano, P.C.

[57] ABSTRACT

A casing fill and circulator assembly is disclosed. The fill valve is constructed so that the valve member moves out of the main flowpath when the valve is in the open position. The valve is constructed so that flow opens it and the majority of the pressure drop is taken in an area other than the interface between the valve member and the seat. For circulation, the apparatus is advanced further into the casing until a cup seal closes off the top of the casing. Once flow is initiated in that condition, internal pressure in the casing, at very low applied pressures, opens a circulation valve and closes the fill valve so that circulation through the casing is accomplished through the circulation valve while bypassing the fill valve. Erosive effects from flow on the fill valve are thus eliminated during circulation. An alternative dual-function valve in a circulator/filling apparatus is also disclosed where a control system senses applied pressure in the apparatus and opens the valve. If the apparatus has been inserted into the casing such that the top of the casing is closed with the cup seal, the same valve is then used to circulate.

21 Claims, 3 Drawing Sheets

U.S. PATENT DOCUMENTS

| | | | |
|---|---|---|---|
| 4,290,482 | 9/1981 | Brisco . | |
| 4,522,430 | 6/1985 | Stromberg . | |
| 4,524,998 | 6/1985 | Brisco . | |
| 4,566,168 | 1/1986 | Stromberg . | |
| 4,613,161 | 9/1986 | Brisco . | |
| 4,624,483 | 11/1986 | Stromberg . | |
| 4,655,286 | 4/1987 | Wood . | |
| 4,718,495 | 1/1988 | Lubitz et al. . | |
| 4,817,724 | 4/1989 | Funderburg, Jr. et al. . | |
| 4,913,231 | 4/1990 | Muller et al. . | |
| 4,997,042 | 3/1991 | Jordan et al. . | |
| 5,152,554 | 10/1992 | LaFleur et al. . | |
| 5,191,939 | 3/1993 | Stokley . | |
| 5,236,035 | 8/1993 | Brisco et al. . | |
| 5,249,629 | 10/1993 | Jennings . | |
| 5,282,653 | 2/1994 | LaFleur et al. . | |
| 5,411,095 | 5/1995 | Ehlinger et al. | 166/154 X |
| 5,413,171 | 5/1995 | Womack . | |
| 5,435,390 | 7/1995 | Baugh et al. . | |
| 5,441,310 | 8/1995 | Barrett et al. . | |
| 5,443,122 | 8/1995 | Brisco . | |
| 5,499,687 | 3/1996 | Lee | 166/154 X |
| 5,501,280 | 3/1996 | Brisco . | |
| 5,553,667 | 9/1996 | Budde et al. . | |
| 5,584,343 | 12/1996 | Coone . | |
| 5,641,021 | 6/1997 | Murray et al. . | |
| 5,660,234 | 8/1997 | Hebert et al. . | |
| 5,735,348 | 4/1998 | Hawkins, III . | |

OTHER PUBLICATIONS

PBL Drilling Tools, Ltd., Brochure, Hydro Mechanical Casing Circulator.

Composite Catalog, "Brown Duo–Packer", p. 919.

Composite Catalog, Baker Packers, "Waterflood Systems", p. 701, 1985.

Composite Catalog, Arrow Oil Tools, Inc., Retrievable Bridge Plug, p. 296, 1985.

Composite Catalog, Bowen Power Equipment, Bowen Power Swivels, pp. 565, 567, 1986–87.

Wepco Brochure, "Hydraulically Operated Circulation Head", undated.

Miscellaneous information on Davis–Lynch, Inc. Fill and Circulate (FAC) Tool for Top Drive Drilling Systems, 2 pages, date unknown.

Halliburton Services, information on Quick–Latch Coupler Head, Oil & Gas Journal, 1 page, Oct. 1988.

Miscellaneous information on Halliburton Services Plug Containers, Selective Release Plug System and SSR(Sub–Surface Release)Cementing Plug Method, 4 pages, date unknown.

Frank's International, Brochure on Fill–Up & Cementing Tool System and FC–1 Fill–Up & Circulating Tool With Sliding Sleeve, 2 pages, date unknown.

Frank's Hilltop, drawings, 5 pages, date unknown.

HiTop Oil Tools, Miscellaneous information on Model FC–1 Fill–Up Circulation Tool, 2 pages, date unknown.

Drawing of Lafleur Petroleum Services AutoSeal Circulating Head, 1 page, date unknown.

Miscellaneous information on Tam International Casing Circulating Packers, 8 pages, date unknown.

CASING FILLING AND CIRCULATING APPARATUS

FIELD OF THE INVENTION

The field of this invention relates to filling casing while it is being run in the hole and circulating it to aid in its proper positioning as it is being advanced into the wellbore.

BACKGROUND OF THE INVENTION

Casing for a wellbore that has just been drilled is assembled at the surface as joints are added and the string is lowered into the wellbore. As the joints are added at the surface on the rig floor, it is desirable to fill the casing. Filling the casing before it is run into the wellbore prevents pressure imbalances on the casing as it is being advanced into the wellbore. Additionally, once the casing is filled, it may be desirable to circulate through the casing as it is being run into the wellbore. It may also be desirable to rotate the casing as it is being advanced into the wellbore. Prior devices have been developed to fill the casing and to circulate it. These devices used in the past are illustrated in U.S. Pat. Nos. 4,997,042 and 5,191,939. These devices illustrated in these patents employed an inflatable element which would seat against the inside of the casing, followed by a mechanical setdown force which opened ports to allow for circulation. Filling in this device was accomplished by displacement of a valve member past a lateral port to expose the lateral port to allow the casing to fill. One of the problems with the prior designs is that excessive erosion occurred at the valve member used for filling the casing, undermining its reliability. Additionally, the inflatable member used to isolate the top of the casing for the purposes of circulation also required maintenance. In order to circulate with the prior designs, not only did an inflatable have to get a good sealing grip on the inside of the casing, but also the circulating ports had to be mechanically exposed using setdown weight. The configuration and nature of the operation of these prior designs made them prone to erosion. Additionally, there were complexities in the normal operations of such designs which required the dropping of balls in order to activate a valve member for filling, as well as the use of an inflatable for sealing.

Accordingly, it is an object of the present invention to provide a system that simplifies the construction of the apparatus useful for filling and circulating casing. The fill valve has been designed to minimize erosive effects and simplify the operation. Another object of the apparatus is to eliminate the use of inflatables to simplify the design and the cost of constructing the apparatus. Accordingly, alternatives to inflatables, such as cup seals, have been employed. Finally, to facilitate the operation of the apparatus, the circulation valve has been configured to easily open fully, while at the same time allowing the fill valve to close so that the fill valve does not encounter the erosive effects of flow during circulation. In a further effort to streamline the design, another objective has been to provide an apparatus with an appropriate control so that a singular valve can provide a dual function of filling and circulating. These and other objectives accomplished by the apparatus will become more apparent from a review of the detailed description below.

SUMMARY OF THE INVENTION

A casing fill and circulator assembly is disclosed. The fill valve is constructed so that the valve member moves out of the main flowpath when the valve is in the open position. The valve is constructed so that flow opens it and the majority of the pressure drop is taken in an area other than the interface between the valve member and the seat. For circulation, the apparatus is advanced further into the casing until a cup seal closes off the top of the casing. Once flow is initiated in that condition, internal pressure in the casing, at very low applied pressures, opens a circulation valve and closes the fill valve so that circulation through the casing is accomplished through the circulation valve while bypassing the fill valve. Erosive effects from flow on the fill valve are thus eliminated during circulation. An alternative dual-function valve in a circulator/filling apparatus is also disclosed where a control system senses applied pressure in the apparatus and opens the valve. If the apparatus has been inserted into the casing such that the top of the casing is closed with the cup seal, the same valve is then used to circulate.

DETAILED DESCRIPTION OF THE PREFERRED EMBODIMENT

Figures 1, 2, 3, 4:
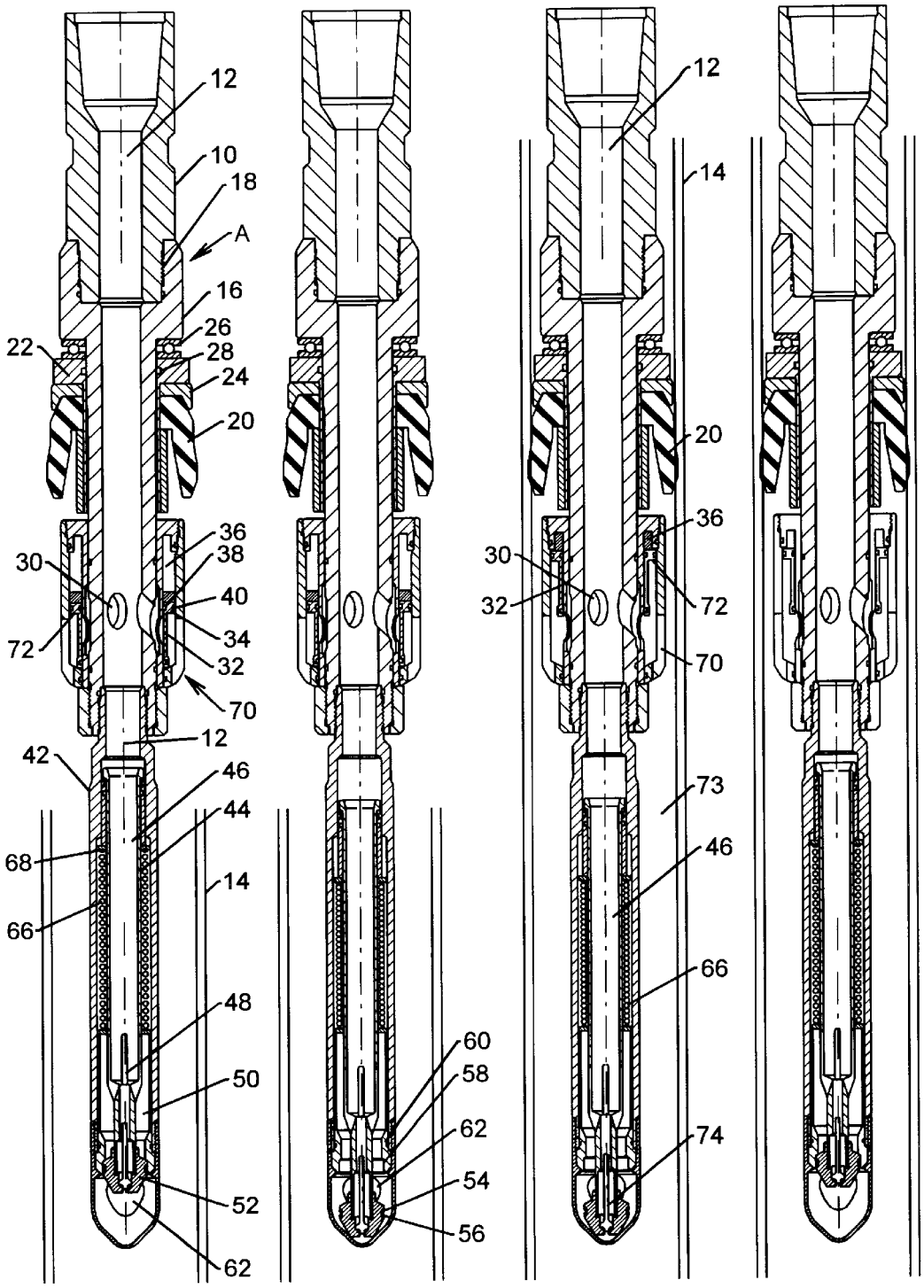
FIG. 1 is a sectional elevational view of the apparatus with the fill valve in the closed position.
FIG. 2 is the view of FIG. 1, with the fill valve in the open position for filling the casing.
FIG. 3 is the view of FIG. 1, except that the apparatus has been advanced into the casing to seal against its inside diameter and the fill valve and circulation valves have been opened.
FIG. 4 is the view of FIG. 3, with the fill valve closed.

Referring to FIG. 1, the apparatus A is supported from the top drive (not shown) and has a top sub 10 with an internal passage 12. Internal passage 12 is connected to the mud pumps (not shown) for filling and circulating of the casing 14. Top sub 10 is connected to body 16 at thread 18. A cup seal 20 is mounted to sleeve 22 with support ring 24 mounted in between. A bearing 26 allows body 16 to remain stationary while the cup seal 20 can rotate with the casing 14 when inserted into the casing 14, as shown in FIG. 3. Seal 28 seals between rotating sleeve 22 and stationary body 16.

Body 16 has a series of ports 30 which are closed off by a sleeve 32. Sleeve 32 has a piston component 34. Piston component 34 is separated from chamber 36 by seals 38 and 40.

Body 16 is connected to valve body 42. Mounted within valve body 42 is sliding sleeve 44, which further has an internal bore 46 in fluid communication with internal passage 12. Sleeve 44 has a plurality of outlets 48 which provide fluid communication from bore 46 into cavity 50. Sleeve 44 terminates in a valve plug 52. As better shown in FIG. 2, valve plug 52 has a pair of seals 54 and 56 which, in the closed position of the valve, contact the sealing surface 58 of the seat 60. The valve body 42 has an outlet 62 which, as shown in FIG. 2, is positioned in such a manner that the valve plug 52 is substantially below the opening 62 when it is in the open position. Accordingly, in the position shown in FIG. 2, flow from the rig pumps (not shown) enters passage 12 and flows through bore 46 through openings or outlets 48, past the sealing surface 58 and out the outlet 62. The bore 46 is sized to take the bulk of the pressure drop across the body 42. The sleeve 44 is biased to the closed position of FIG. 1 by spring 66 acting on tab 68, which extends from sleeve 44. The spring 66 is designed to hold the valve closed when the rig pumps are turned off to avoid spillage of mud on the rig floor. The spring 66 is also sized to be readily overcome as soon as the rig pumps are turned on.

Thus, when flow is initiated from the rig pumps with the cup seal 20 outside of the casing 14, as shown in FIG. 1, the movement of sleeve 44 occurs, as can be seen by comparing FIGS. 1 and 2. The slightest pressure build-up, which occurs very quickly after the rig pumps are turned on, is designed to move the sleeve 44 into the open position and to get the plug 52 with seals 54 and 56 substantially out of the exit path of the fluid through outlet 62. Since most of the pressure drop through the body 42 occurs within bore 46, the plug 52 remains firmly in the position shown in FIG. 2 when the rig pumps (not shown) are pumping mud for filling the casing. Pressure applied in passage 12 does not open the circulating valve 70. This is because it takes pressure on piston component 34 on surface 72 in order to move the sleeve 32. Thus, with the cup seal 20 outside the casing 14, applied pressure in internal passage 12 will only result in opening the fill valve within body 42.

When the casing has been filled and it is desired to circulate the casing, the apparatus A is further lowered to the position shown in FIG. 3 so that the cup seal 20 engages the inside of the casing 14. In this position, when the mud pumps are again turned on, the plug 52 is again immediately displaced into the open position, away from outlet 62. Since the upper end of the casing 14 is now closed off by cup seal 20, pressure develops in the annular space 73 around the body 42. That pressure acts on surface 72 to displace the sleeve 32 and reduce the volume of chamber 36. As soon as the sleeve 32 moves beyond openings 30 and with the cup seal 20 sealing against the inside of the casing 14, circulation of the casing can occur as pressure from the mud pumps is forced down to the bottom of the casing and out and around its exterior back to the surface. It should be noted that as soon as the circulating valve 70 opens, the differential across the sleeve 44 is reduced so that the spring 66, which had been compressed until the valve 70 opened, can now relax and bring up with it the valve plug 52 to again close off the outlet 62. This is the position shown in FIG. 4. This process may be repeated for each stand of casing that is added. Those skilled in the art will appreciate that while cup seals have been shown for the sealing mechanism 20, other types of seals can be used without departing from the spirit of the invention. Additionally, the configuration of the valve internals within body 42 can be altered without departing from the spirit of the invention. Thus, instead of using a spring return, other types of returns can be used to urge the valve within body 42 into a closed position. It is desirable for the valve in body 42 to be in the closed position when the rig pumps are not running so that residual mud within the body 42 does not spill on the rig floor when the apparatus A is extracted from the top of the casing.

Another feature of the fill valve is a check valve 74 which is located in the lower end 64. Prior to pulling the cup seal 20 out of the casing after circulating the casing and prior to adding another section of casing, the check valve 74 allows venting of any excess pressure out through bore 46 and passage 12 where, at a location near the rig pumps (not shown) the pressure is automatically relieved. Thus, the purpose of the check valve 74 is to prevent rig personnel from pulling the cup seals 20 out of the casing 14 while there is pressure in the annular space 73.

Figure 5:
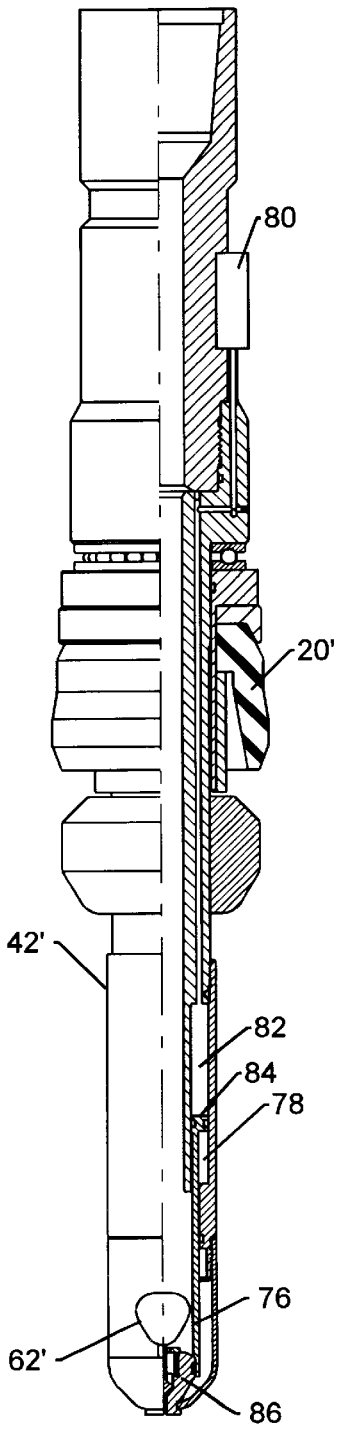
FIG. 5 is a sectional elevational view of the apparatus, showing a singular valve with a multi-purpose function of filling or circulating, showing the valve in the closed position in a configuration where it is biased to the open position, using a pressurized cavity.
Figure 6:
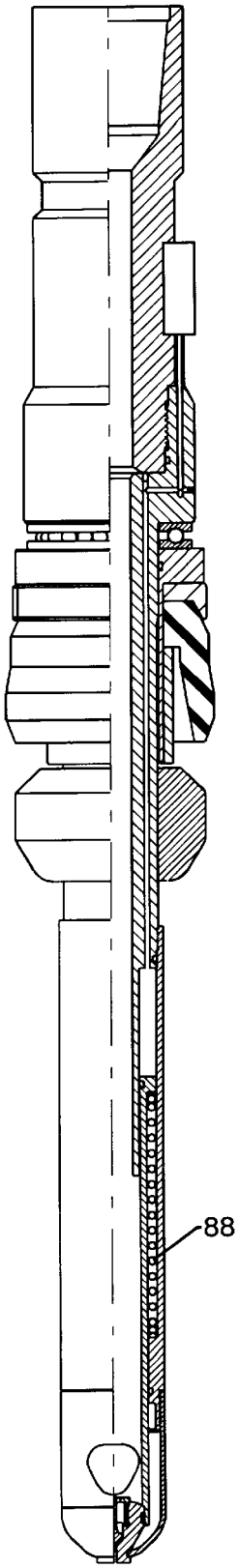
FIG. 6 is the configuration of FIG. 5, using a spring for the opening bias instead of a pressurized cavity.
Figure 7:
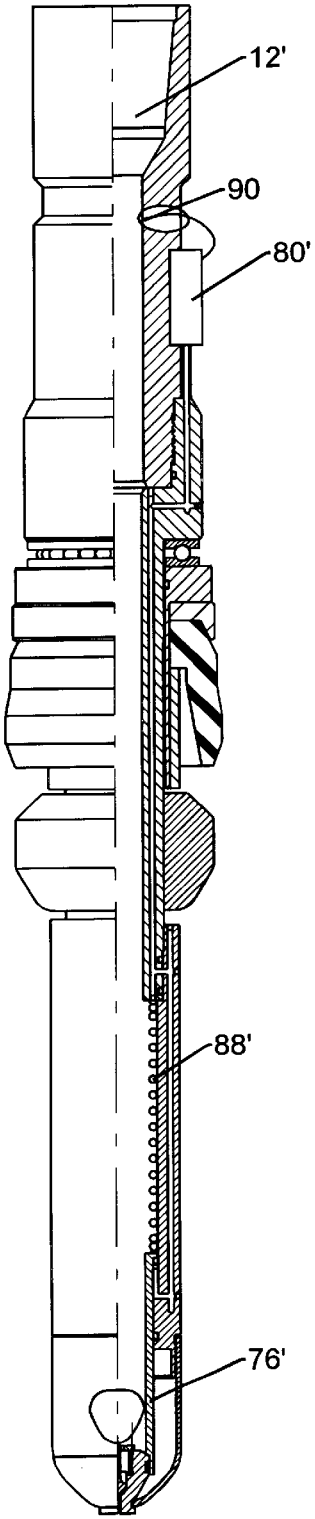
FIG. 7 is the view of FIG. 6, except the valve is biased by a spring to the closed position.
Figure 5A:
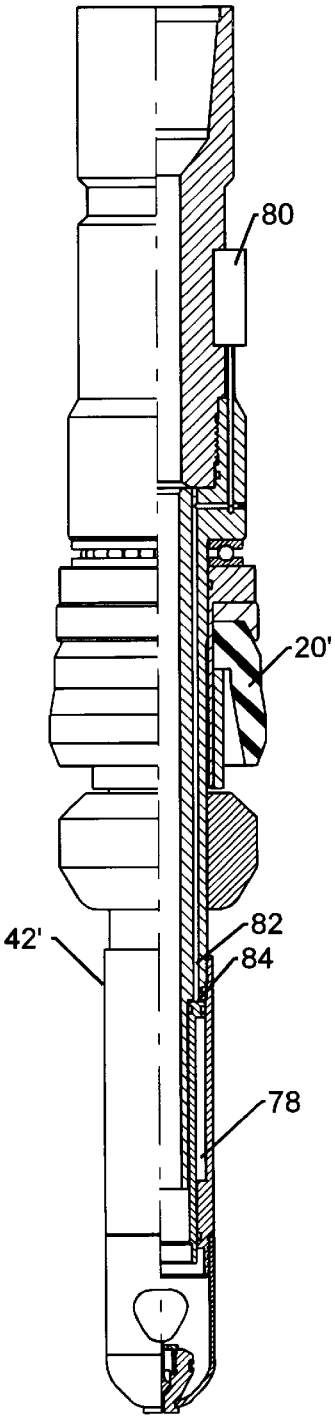
FIG. 5*a* is the view of FIG. 5, with the valve in the open position.
Figure 6A:
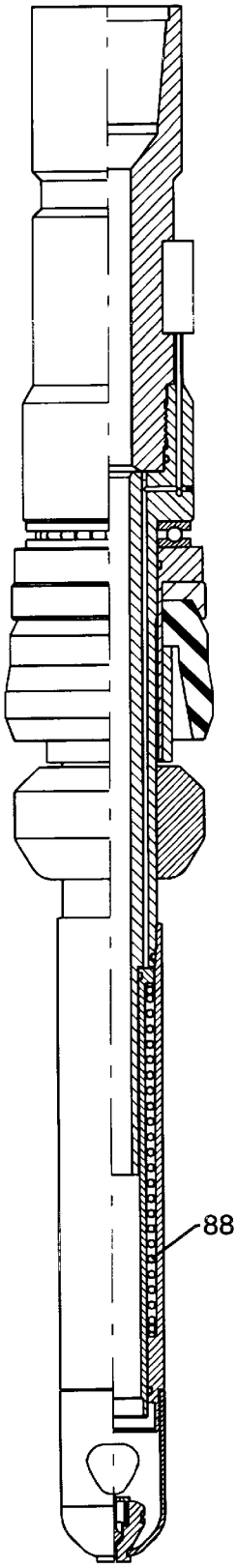
FIG. 6*a* is the view of FIG. 6, with the valve in the open position.
Figure 7A:
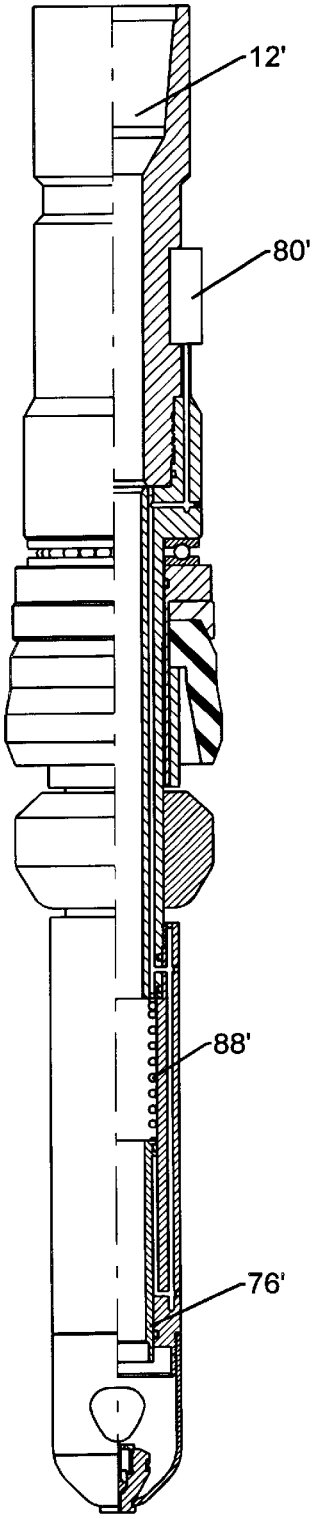
FIG. 7*a* is the view of FIG. 7, with the valve in the open position.

Referring now to FIGS. 5–7, a combination fill and circulating valve is disclosed. Thus, for example, in FIG. 5, the same type of cup seal 20' is used, with the fill valve body 42' including an outlet 62'. Inside the body 42' is a sliding sleeve 76 which defines a pressurized chamber 78. The pressurized chamber tends to push the sleeve 76 upwardly. A controller 80 can direct hydraulic pressure into cavity 82 to apply a force on surface 84 which, in turn, at a predetermined pressure in cavity 82, overcomes the force from chamber 78 to push the sleeve 76 downwardly. The controller can employ a microprocessor, hydraulic logic, or a combination of hydraulic porting to achieve the desired sleeve movements. Shown schematically in FIG. 5 is the valve member 86 in the closed position. When the controller reduces the pressure in chamber 62, the pressurized chamber 78 will move the sliding sleeve 76 upward, opening the valve as shown in FIG. 5*a*. The valve member or seat 86 is always positioned well below the opening 62 and is, therefore, not subject to the erosional effects of the mud flow stream; the same is true for the valve member in FIGS. 6 and 7. The configuration of the valve member or seat 86 can be similar to that shown in FIGS. 1–4, or in the alternative, the movement of the sleeve 76 can interact with valve members or seats of other designs. In the preferred embodiment, regardless of the configuration of the valve member, the movement of the sleeve 76 moves the sealing components on the lower end of the sleeve 76 substantially out of the flowpath leading to the exit port 62'.

The embodiment of FIG. 6 is substantially the same as FIG. 5 except that a return spring 88 is used instead of a pressurized chamber 78.

The embodiment in FIG. 7 is similar to the operation of the embodiment of FIG. 6 except the spring 88' biases the sleeve 76' in a direction to close the valve rather than to open it, as shown in FIG. 6. It should be noted that the controller, such as 80 shown in FIG. 5 or 80' shown in FIG. 7, can be connected to sense the internal pressure in passage 12' through a sensing apparatus schematically shown as 90. With the valve in the normally closed position, a build-up of pressure can be sensed by the controller 80' and fluid pressure applied to shift the sleeve 76 or 76'. Conversely, if the valve member 86 is in the normally open position, the controller 80' can sense a stoppage of flow in the passage 12' and close the valve member 86. Other configurations of controls can be adapted depending on the particular application. It is desirable not to deadhead the rig pumps so as to build pressure within the apparatus A; thus, in the embodiments shown in FIGS. 5–7, the sealing areas exposed to the mud pump pressure in 12 can be of such sizes that the seal area between the valve member 86 and sliding sleeve 76 is larger than the sealing area between the sliding sleeve 76 and body 42'. With this arrangement, the forces on the sliding sleeve will be such that the sliding sleeve 76 is urged to the up or open position with increasing pump pressure, thus not requiring a quick response from the controller to prevent deadheading of the pump pressure.

One of the advantages of the embodiment in FIGS. 5–7 is that the construction of the apparatus A is simpler and cheaper and the valve member 86 accomplishes a dual purpose of filling as well as circulating, depending on whether the cup seal 20' or any other type of seal used is located within the casing (omitted from FIGS. 5–7 for clarity).

Thus, one of the advantages of the embodiment of FIGS. 1–4 is that the fluid pressure in the casing readily opens the circulating valve 70 and allows the fill valve in body 42 to close. Thus, the operation of the fill valve is more reliable. Erosive effects in the fill valve are reduced by the configuration described in that the lower end 64 is moved out of the flowpath to exit 62. During normal flow, the sleeve 44 is immediately shifted to its full open position shown in FIG. 2, thus reducing chatter and wear on the sealing surface 58 as most of the pressure drop is taken across bore 46. The embodiment illustrated in FIGS. 1–4 is the preferred embodiment. The advantages of the embodiments illustrated in FIGS. 5–7 are a simpler construction, with a dual-purpose valve that facilitates filling when the seal 20' is out of the casing, as well as circulation when the seal 20' is in the casing.

As shown in FIGS. 5*a*–7*a*, the movable sleeve 76 moves away from the seat 86 and moves up sufficiently so that its lower end moves past outlet 62. Flow through the sleeve will not erode its lower end since it is displaced sufficiently so that its lower end is not in the path of outlet 62'.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for filing or circulating casing, comprising:

a body having a flowpath therethrough, insertable into the casing;

a valve in said body further comprising a valve plug and seat, said body defining an opening;

said valve plug, on application of fluid pressure in said body, is displaced such that said valve plug is moved toward a position where it is substantially out of a fluid flowpath extending through said body and out through said opening; and said valve plug further comprises a shiftable tube extending therefrom and moving therewith, having a bore therethrough in fluid communication with said flowpath.

2. The apparatus of claim 1, wherein:

said tube is biased to hold said valve plug against said seat.

3. The apparatus of claim 2, wherein:

said bias is overcome by flow through said tube.

4. The apparatus of claim 3, wherein:

flow through said bore in said tube is designed to readily overcome said bias by virtue of a pressure imbalance acting on said tube so that said valve plug readily attains a fully open position near in time to the onset of flow through said bore.

5. The apparatus of claim 1, further comprising:

a seal on the outer periphery of said body which is engageable with the casing when said body is inserted in the casing;

a circulation valve mounted to said body, said circulation valve operable by pressure developed against it in the casing as a result of fluid pressure communicated around said valve plug and through said opening in said body.

6. The apparatus of claim 5, wherein:

said seal, when inserted into said casing, closes off the top of the casing to allow pressure buildup to open said circulation valve, whereupon said valve plug returns into contact with said seat so that substantially all fluid entering said body exits through said circulation valve.

7. The apparatus of claim 6, wherein:

said valve plug is biased into contact with said seat, whereupon flow through said body overcomes said bias to displace said valve plug from said seat.

8. The apparatus of claim 7, wherein:

said bias moves said valve plug against said seat as a result of opening of said circulation valve, which causes a reduction of the force available to overcome said bias.

9. The apparatus of claim 8, wherein:

said seal on said body comprises a cup seal.

10. A casing fill and circulation apparatus, comprising:

a body having a lower end and a flowpath therethrough which terminates at an outlet;

a movable valve member in said body comprising a shifting sleeve having a lower end;

a seal on the body to interact with the inside of the casing;

whereupon the casing can be filled by moving said valve member in the body to a point where it is substantially out of the flowpath near the outlet of said body, with said seal out of contact with the casing, and the casing can be circulated by engaging said seal to the casing and pumping fluid through said flowpath in said body;

said body comprises a seat between its lower end and said outlet for engagement with said sleeve to close off said flowpath which extends through said sleeve; and said sleeve movable to an open position wherein its lower end, which contacts said seat when said flowpath is closed off. Is moved past said outlet in said body when actuated to permit flow through said flowpath.

11. The apparatus of claim 10, further comprising:

a control system to selectively operate said valve member for opening and closing the flowpath in said body.

12. The apparatus of claim 10, wherein:

said valve member is responsive to applied pressure in said flowpath to open said flowpath for flow.

13. The apparatus of claim 11, wherein:

said valve member is biased to a closed position;

said control system applies a fluid force in said body to overcome said bias on said valve member.

14. The apparatus of claim 13, wherein:

said bias comprises a chamber comprising at least in part a compressible fluid.

15. The apparatus of claim 13, wherein:

said bias comprises a spring.

16. The apparatus of claim 12, wherein:

said valve member is biased to close off said flowpath by a chamber comprising at least in part a compressible fluid.

17. The apparatus of claim 10, wherein:

said valve member is biased to close off said flowpath by a spring.

18. The apparatus of claim 10, wherein:

said valve member comprises a shifting sleeve;

said body comprises a seat for engagement with said sleeve to close off said flowpath, which extends through said sleeve, and an outlet in said body at the end of said flowpath;

said sleeve movable to an open position wherein its lower end, which contacts said seat when said flowpath is closed off, is moved past said outlet in said body when actuated to permit flow through said flowpath.

19. A casing fill and circulation apparatus, comprising:

a body having at least one port and a flowpath therethrough, insertable into the casing;

a cup seal on the outer periphery of said body which is engageable with the casing when said body is inserted in the casing; and a circulation valve mounted to said body, said circulation valve operable by fluid pressure developed against it to selectively access said port.

20. The apparatus of claim 19, wherein:

said cup seal is loosely mounted to said body such that said body may remain stationary while said cup seal rotates with the casing.

21. The apparatus of claim 19, wherein:

said body comprises a main body which comprises said port and said circulation valve and a lower body, said main body providing a travel stop to movement of said circulation valve.

* * * * *